US010989398B2

(12) United States Patent
Winters et al.

(10) Patent No.: US 10,989,398 B2
(45) **Date of Patent: *Apr. 27, 2021**

(54) SELF-CONTAINED JUNCTION BOX

(71) Applicant: SIGNIFY HOLDING B.V., Eindhoven (NL)

(72) Inventors: Philip Dean Winters, Senoia, GA (US); Grzegorz Wronski, Peachtree City, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 42 days.

This patent is subject to a terminal disclaimer.

(21) Appl. No.: 16/370,625

(22) Filed: Mar. 29, 2019

(65) Prior Publication Data

US 2019/0226669 A1 Jul. 25, 2019

Related U.S. Application Data

(63) Continuation of application No. 15/263,198, filed on Sep. 12, 2016, now Pat. No. 10,247,399.

(51) Int. Cl.

| | |
|---|---|
| ***F21V 21/04*** | (2006.01) |
| ***F21V 23/00*** | (2015.01) |
| ***F21V 23/02*** | (2006.01) |
| *F21Y 115/10* | (2016.01) |
| *F21Y 103/33* | (2016.01) |

(52) U.S. Cl.

CPC ..... *F21V 23/026* (2013.01); *F21V 21/042* (2013.01); *F21V 23/001* (2013.01); *F21V 23/008* (2013.01); *F21Y 2103/33* (2016.08); *F21Y 2115/10* (2016.08)

(58) Field of Classification Search

CPC .... F21V 23/026; F21V 23/001; F21V 23/008; F21V 21/042; F21Y 2103/33

See application file for complete search history.

(56) References Cited

U.S. PATENT DOCUMENTS

| | | | | |
|---|---|---|---|---|
| 6,343,873 | B1 | 2/2002 | Eberhard | |
| 8,696,158 | B2 | 4/2014 | Santiago | |
| 10,247,399 | B1 * | 4/2019 | Winters | F21V 21/042 |
| 10,502,404 | B1 * | 12/2019 | Bowen | F21V 23/04 |
| 2005/0183344 | A1 | 8/2005 | Ziobro | |
| 2010/0061108 | A1 | 3/2010 | Zhang | |
| 2011/0267826 | A1 | 11/2011 | Santiago | |
| 2012/0275162 | A1 | 11/2012 | Spiro | |
| 2013/0100658 | A1 | 4/2013 | Pickard | |
| 2013/0215623 | A1 | 8/2013 | Goodman | |
| 2014/0268825 | A1 | 9/2014 | Lay | |
| 2017/0307154 | A1 * | 10/2017 | Duckworth | F21S 9/022 |
| 2019/0063701 | A1 * | 2/2019 | Lotfi | F21V 23/026 |

* cited by examiner

*Primary Examiner* — Anabel Ton

(57) ABSTRACT

A lighting structure includes a junction box that has a cavity, and a mounting plate that has an inner section and a perimeter section. The junction box is attached to the mounting plate, and the mounting plate has a wire opening therethrough for routing an electrical wire from the junction box to a light source. The perimeter section of the mounting place is outside the junction box.

20 Claims, 10 Drawing Sheets

SELF-CONTAINED JUNCTION BOX

CROSS REFERENCE TO RELATED APPLICATIONS

The present application is a continuation of and claims priority to U.S. Nonprovisional patent application Ser. No. 15/263,198, filed Sep. 12, 2016 and titled "Self-Contained Junction Box," the entire content of which is incorporated herein by reference.

TECHNICAL FIELD

The present disclosure relates generally to lighting fixtures, and more particularly to a lighting structure and junction box assembly of a lighting fixture.

BACKGROUND

Junction boxes are often used for placement of lighting drivers of lighting fixtures and for making safe wiring connections. Typically, a junction box is separate from a light fixture. For example, the junction box may be structurally unattached to a light fixture, or may be attached to a light fixture by a joining structure (e.g., an arm) extending therebetween. However, in some applications, a structurally separate junction box or a junction box that is attached to a light fixture by a joining structure may be inconvenient and/or undesirable. For example, a space that is available behind a ceiling may be small or otherwise limited. In retrofitting installations, use of an existing junction box or installing a new junction box may be challenging and result in added cost. Further, in cases such as temporary installations (e.g., during building construction phases), use of a separate junction box may add to cost.

Thus, in some applications, a solution that avoids use of a structurally separate junction may be desirable.

SUMMARY

The present disclosure relates to a lighting structure and junction box assembly of a lighting fixture. In an example embodiment, a lighting structure includes a junction box that has a cavity, and a mounting plate that has an inner section and a perimeter section. The junction box is attached to the mounting plate, and the mounting plate has a wire opening therethrough for routing an electrical wire from the junction box to a light source. The perimeter section of the mounting plate is outside the junction box.

In another example embodiment, a lighting fixture includes a light source, a junction box having a cavity, and a mounting plate having an inner section and a perimeter section. The junction box is attached to the inner section of the mounting plate on a first side of the mounting plate. The light source is attached to the mounting plate on a second side of the mounting plate. The mounting plate has a wire opening for routing an electrical wire between the junction box and the light source. The inner section of the mounting plate is outside the junction box.

In another example embodiment, a lighting fixture includes a light emitting diode (LED) driver and a junction box that has a cavity. The driver is positioned inside the cavity. The lighting fixture also includes a mounting plate that has an inner section and a perimeter section, where the junction box is attached to the inner section of the mounting plate. The mounting plate has a wire opening for routing an electrical wire between the junction box and a light source. The perimeter section of the mounting plate is outside the junction box.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
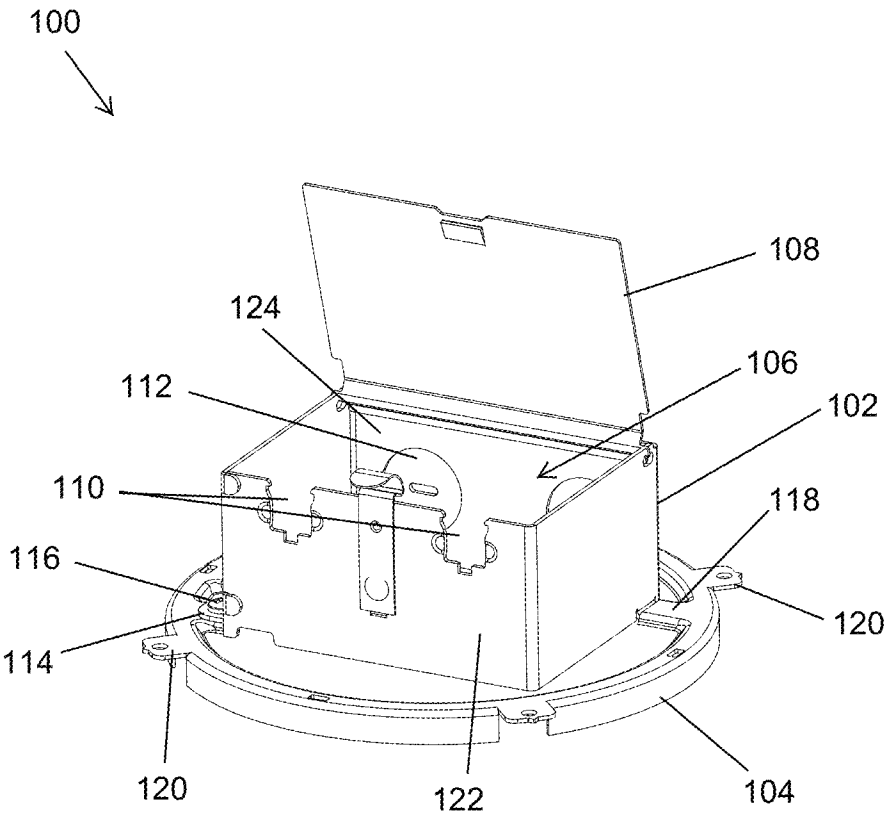
FIG. 1 illustrates a lighting structure including a junction box according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the figures, the same reference numerals used in multiple drawings designate like or corresponding but not necessarily identical elements.

DETAILED DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Turning now to the drawings, FIG. 1 illustrates a lighting structure 100 including a junction box 102 according to an example embodiment. The lighting structure 100 includes the junction box 102 and a mounting plate 104. The junction box 102 is attached to the mounting plate 104 on one side of the mounting plate 104.

In some example embodiments, the junction box 102 may include a top cover 108 that is shown opened in FIG. 1. The junction box 102 may be attached to the mounting plate 104 using attachment tabs including an attachment tab 114. For example, a fastener 116 may be used to secure the junction box 102 with the mounting plate 104. The junction box 102 also has a cavity 106 that is partially bound by walls 122, 124. For example, the top cover 108 may be rotatably attached to the wall 124 as shown in FIG. 1. Alternatively, the top cover 108 may be to another wall or in a non-rotatable manner without departing from the scope of this disclosure. As described in more detail below, the lighting driver may be positioned in the cavity 106. Alternatively or in addition, wire connections may be in the cavity 106. In general, the junction box 102 may be used for various purposes including customarily junction box purposes.

In some example embodiments, the junction box 102 includes one or more wire passageways 110. For example, the wire passageways 110 may be formed in the wall 122 as shown in FIG. 1 or in another wall of the junction box 102. The wire passageways 110 may be used to route one or more electrical wires into the cavity 106 of the junction box 102, for example, from a mains power source. The junction box 102 may also include one or more knockout sections 112 that can be removed for purposes such as routing wires, conduits, and in general to provide access to the cavity 106 of the junction box 102. For example, the knockout sections 112 may be formed in the wall 124. Alternatively or in addition, the knockout sections 112 may be formed in the wall 122 or in other walls of the junction box 102. The knockout sections may have a dimension (e.g., industry standard ½ inch) suitable for various purposes.

In some example embodiments, the mounting plate 104 includes an elevated attachment section 118 that is used to securely attach the junction box 102 with the mounting plate 104 as described below. The mounting plate 104 may also include mounting tabs 120. For example, the mounting tabs 120 may extend out from a perimeter section of the mounting plate 104 and may be used to attach the mounting plate 104, for example, with a trim ring of a lighting fixture. For example, the mounting tabs 120 may be integrally formed with the mounting plate 104. To illustrate, the mounting tabs 120 may be formed in sheet metal that is used to make the mounting plate 104.

In some example embodiments, the junction box 102 and the mounting plate 104 are made from sheet metal using stamping, die casting, and/or other methods as can be contemplated by those of ordinary skill in the art with the benefit of this disclosure. For example, the mounting plate 104 can serve as a heat sink for a lighting fixture. In some alternative embodiments, the junction box 102 and the mounting plate 104 may be made from plastic.

By using the lighting structure 100, the need for a structurally separately placed junction box can be avoided. For example, the lighting structure 100 can be used in retrofit installations without the need to install a new junction box or having to make wiring connections inside an existing junction box. Further, the lighting structure 100 may be used in installations where space is limited behind ceilings or similar structures. Further, temporary lighting fixture installations may be quickly performed without the need for a separate installation of a junction box.

In some alternative embodiments, the one or more knockout sections 112 of the junction box 102 may be omitted without departing from the scope of this disclosure. The junction box 102 may also have fewer or more wire passageways than shown in FIG. 1 without departing from the scope of this disclosure. Further, the junction box 102 may have a different shape than shown in FIG. 1 without departing from the scope of this disclosure. In some alternative embodiments, the mounting plate 104 may have fewer or more mounting tabs 120 than shown without departing from the scope of this disclosure.

Figure 2:
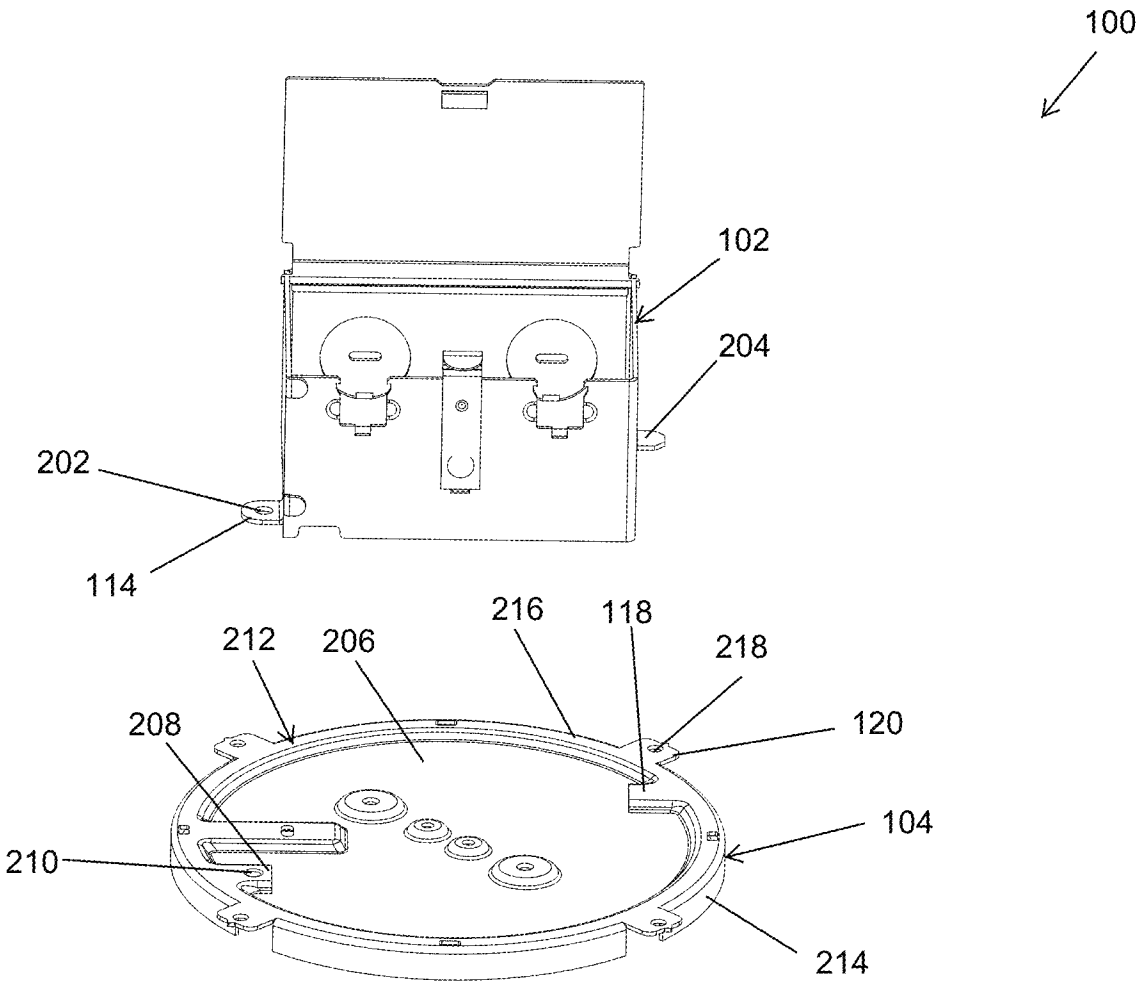
FIG. 2 illustrates an exploded view of the lighting structure of FIG. 1 according to an example embodiment.

FIG. 2 illustrates an exploded view of the lighting structure 100 of FIG. 1 according to an example embodiment. Referring to FIGS. 1 and 2, in some example embodiments, the junction box 102 includes the attachment tab 114 and an attachment tab 204. For example, the attachment tab 114 may extend outwardly at a bottom edge of a side wall of the junction box 102. In some example embodiments, the attachment tab 114 may include a hole 202 for extending the fastener 116 therethrough to secure the junction box 102 with the mounting plate 104.

In some example embodiments, the mounting plate 104 includes an inner section 206 and a perimeter section 212. The perimeter section 212 may include a skirt section 214 that extends down from a ledge section 216 of the perimeter section 212. For example, a light source may be attached to the inner surface of the skirt section 214 below the ledge section 216. In some example embodiments, the junction box 102 may be attached to the inner section 206 such that a portion of the inner section 206 and the perimeter section 212 are outside of the junction box 102. In some alternative embodiments, greater or smaller portions of the inner section 206 than shown may be under the cavity 106 of the junction box 102.

In some example embodiments, the mounting plate 104 includes an elevated attachment section 208 for securely attaching the junction box 102 to the mounting plate 104. To illustrate, a hole 210 may be formed in the elevated attachment section 210, and the fastener 116 is extended through the hole 202 of the attachment tab 114 and the hole 210 to securely attach the attachment tab 114 to the elevated attachment section 210 thereby securely attaching the junction box 102 to the mounting plate 104.

In some example embodiments, the attachment tab 204 is positioned underneath the attachment section 118 to securely attach the junction box 102 to the mounting plate 104. To illustrate, the attachment tab 204 may be inserted in a slot formed at an end of the attachment section 118. In some example embodiments, the junction box 102 can be securely attached to the mounting plate 104 by attaching the attachment tab 114 to the elevated attachment section 208 and by inserting of the attachment tab 204 into the elevated attachment section 118. Because the elevated attachment section 208 is raised upward relative to the inner section 206, an end of the fastener 116 can securely attach the attachment tab 114 to the elevated attachment section 208 without extending below the lowest end of the inner section 206, for example, allowing a lens to be attached to a surface of the mounting plate 104 on an opposite side of the mounting plate 104.

In some example embodiments, the mounting tabs 120 extend outwardly from the ledge section 216 of the perimeter section 212. For example, each mounting tab 120 may include a respective hole 218 that can be used to securely attach the mounting plate 104 to a trim ring or another structure. The mounting tabs 120 may be evenly distributed around the perimeter of the mounting plate 104.

Although the mounting plate 104 is shown as having a round perimeter shape, in alternative embodiments, the mounting plate 104 may have other shapes without departing from the scope of this disclosure. Further, in some alternative embodiments, the elevated attachment section 208 may be omitted where the hole 210 is formed in the inner section 206 without departing from the scope of this disclosure. In some alternative embodiments, the elevated attachment section 118 may be replaced with a structure similar to the elevated attachment section 208 or may be omitted. In some alternative embodiments, the attachment tabs 114, 204 may be omitted and the junction box 102 may be attached to the mounting plate 104 using other means without departing from the scope of this disclosure.

Figure 3:
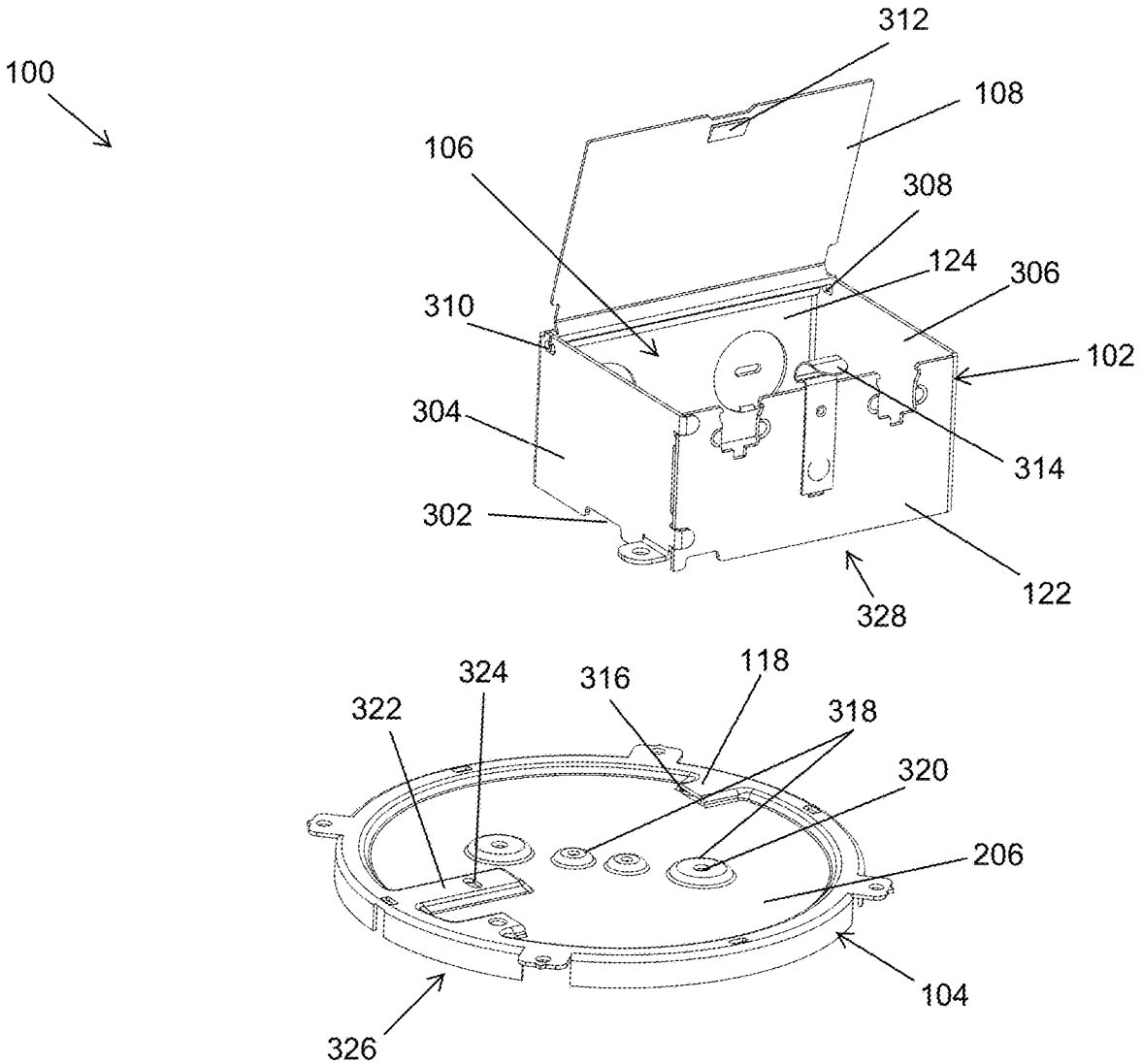
FIG. 3 illustrates another exploded view of the lighting structure of FIG. 1 according to an example embodiment.

FIG. 3 illustrates another exploded view of the lighting structure 100 of FIG. 1 according to an example embodiment. Referring to FIGS. 1-3, in some example embodiments, the junction box 102 includes side walls 304, 306 that extend between the walls 122, 124. In some example embodiments, a notch 302 is formed in the side wall 304 of the junction box 102. For example, the notch 302 may allow an elevated wireway section 322 of the mounting plate 104 to extend into the cavity 106 of the junction box 102 under the side wall 304.

In some example embodiments, the junction box 102 includes attachment slots 308, 310 that are formed in the side walls 306, 304, respectively, for rotatably attaching the top cover 108 of the junction box 102. The junction box 102 may also include a latch 314 that attaches to the wall 122 and/or extends from an edge of the wall 122. For example, an end portion of the latch 314 may be inserted into a latch slot 312 formed in the top cover 108 to retain the top cover 108 in a closed position. In some alternative embodiments, the latch 314 and/or the latch slot 312 may be omitted without departing from the scope of this disclosure.

In some example embodiments, the elevated wireway section 322 of the mounting plate 104 includes a wire hole 324 for routing one or more electrical wires between the cavity 106 of the junction box 102 and one or more light sources that are on the opposite side of the mounting plate 104 from the junction box 102. For example, the wire hole 324 may be in the cavity 106 of the junction box 102, and one or more electrical wires may extend between the cavity 106 and the light sources through the hole 324 without extending outside of the junction box 102.

In some example embodiments, the mounting plate 104 includes a slot 316 formed at an end portion of the elevated attachment section 118. For example, the attachment tab 204 may be inserted in the slot 316 such that the attachment tab 204 is underneath the attachment section 118. Because the attachment section 118 is raised relative to the inner section 206, the attachment tab 204 can remain at or above the level of the inner section 206.

In some example embodiments, the mounting plate 104 includes elevated platforms 318 that have respective attachment holes 320. For example, a lighting driver may be securely attached to the mounting plate 104 using one or more fasteners that extend through one or more of the attachment holes 318. Because the elevated platforms 318 are raised relative to other parts of the inner section 206, ends of fasteners that extend through the attachment holes 318 can remain at or above the level of the inner section on a bottom side 326 of the mounting plate 104, for example, to allow a lens to be attached to the surface of the mounting plate 104 on the bottom side 326 of the mounting plate 104.

In some example embodiments, the junction box 102 may be fully or partially open on a bottom side 328 of the junction box 102. For example, the junction box 102 may have a bottom wall that has wire openings and attachment holes for routing wires and securing a driver to the junction box 102 without departing from the scope of this disclosure.

Although the notch 302 is formed in the side wall 304, in alternative embodiments, the notch 302 may be formed in a different wall of the junction box 102 without departing from the scope of this disclosure. Further, the mounting plate 104 may include more or fewer mounting platforms 318 than shown without departing from the scope of this disclosure.

Figure 4:
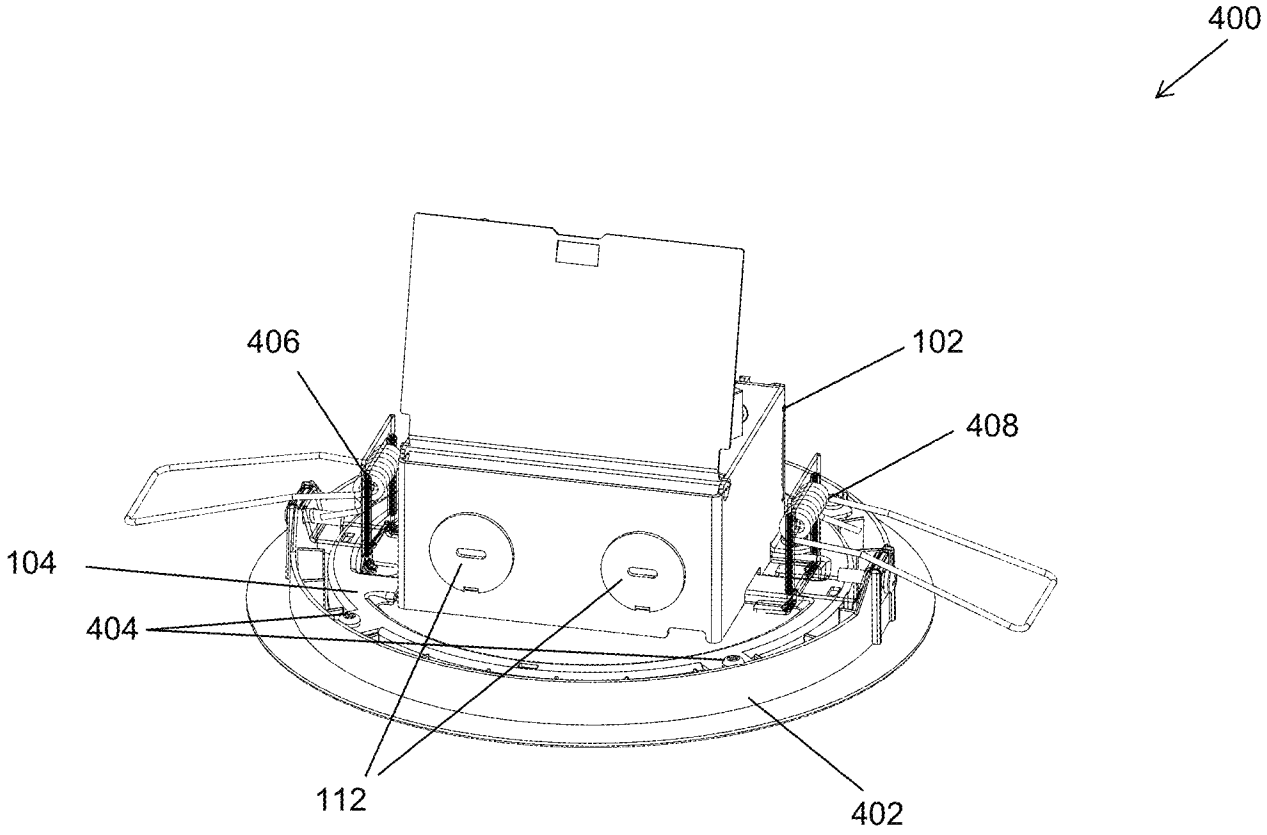
FIG. 4 illustrates a lighting fixture including the lighting structure of FIG. 1 according to an example embodiment.

FIG. 4 illustrates a lighting fixture 400 including the lighting structure 100 of FIG. 1 according to an example embodiment. Referring to FIGS. 1-4, in some example embodiments, the lighting fixture 400 includes the lighting structure 100 and a trim ring 402. For example, the lighting structure 100 may be attached to the trim ring 402 using one or more fasteners 404 that extend through the holes 218 in the mounting tabs 120 of the mounting plate 104 of the lighting structure 100. The knockout sections 112 of the junction box 102 may be removed, if needed, before or after installation of the lighting fixture 400 to extend conduits and/or wires into the junction box 102.

In some example embodiments, the lighting fixture 400 includes retention structures 406, 408 that are used to retain the lighting fixture 400 recessed behind a structure such as a ceiling. For example, the retention structures 406, 408 may each include a mousetrap spring that clamps down on a ceiling after the lighting fixture 400 is installed in recessed position. In some alternative embodiments, a different type of retention structure or a different means may be used to retain the lighting fixture 400 in a recessed position without departing from the scope of this disclosure.

In some alternative embodiments, the trim ring 402 may have shapes other than shown without departing from the scope of this disclosure. Further, the lighting structure 100 may be attached by means other than the fasteners 404 without departing from the scope of this disclosure.

Figure 5:
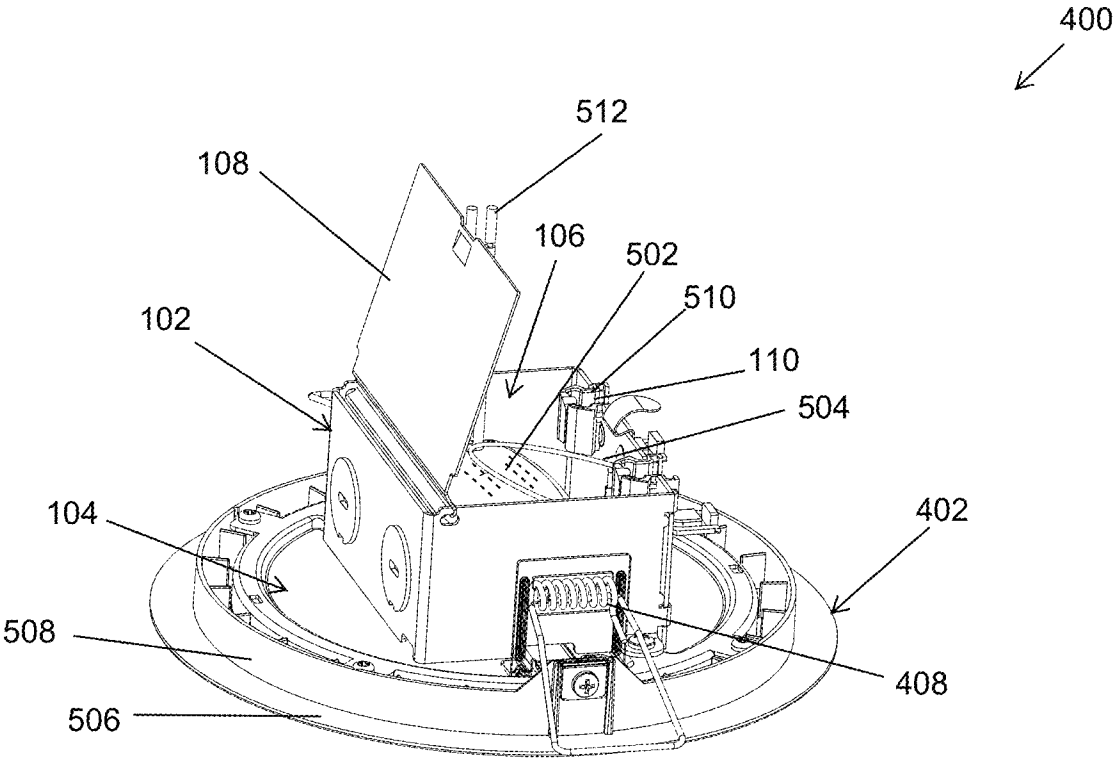
FIG. 5 illustrates another view of the lighting fixture of FIG. 4 according to an example embodiment.

FIG. 5 illustrates another view of the lighting fixture of FIG. 4 according to an example embodiment. Referring to FIGS. 1-5, the lighting fixture 400 includes a lighting driver 502 that is positioned in the cavity 106 of the junction box 102. For example, the driver 502 may be an LED driver that provides power to an LED light source. For example, one or more electrical wires 504 may be routed from the driver 502 through the wire hole 324 to an LED light source that is on the bottom side 326 of the mounting plate 104.

In some example embodiments, one or more electrical wires 512 may be routed from the driver 502 to a power source such as a mains power source that provides AC power. For example, the electrical wires 512 may be routed through the wire passageway 110 that may have a wire trap 510 positioned therein for controlling movement of the electrical wires 512.

In some example embodiments, the trim ring 402 includes a trim ring piece 506 and an insert piece 508. For example, when the lighting fixture 400 is installed in a ceiling, the insert piece 508 may be positioned through a hole in the ceiling while the trim piece 506 remains below the ceiling. As described above, the retention structures 406, 410 can be clamped down onto the ceiling to retain the lighting fixture 400 in a recessed position.

Although the driver 502 is shown positioned in the cavity 106 of the junction box 102, in some alternative embodiments, the driver 502 may be attached to the top cover 108 on the outside of the junction box 102. For example, the driver 502 may be fastened to the top cover 108, and the top cover 108 may be closed.

Figure 6:
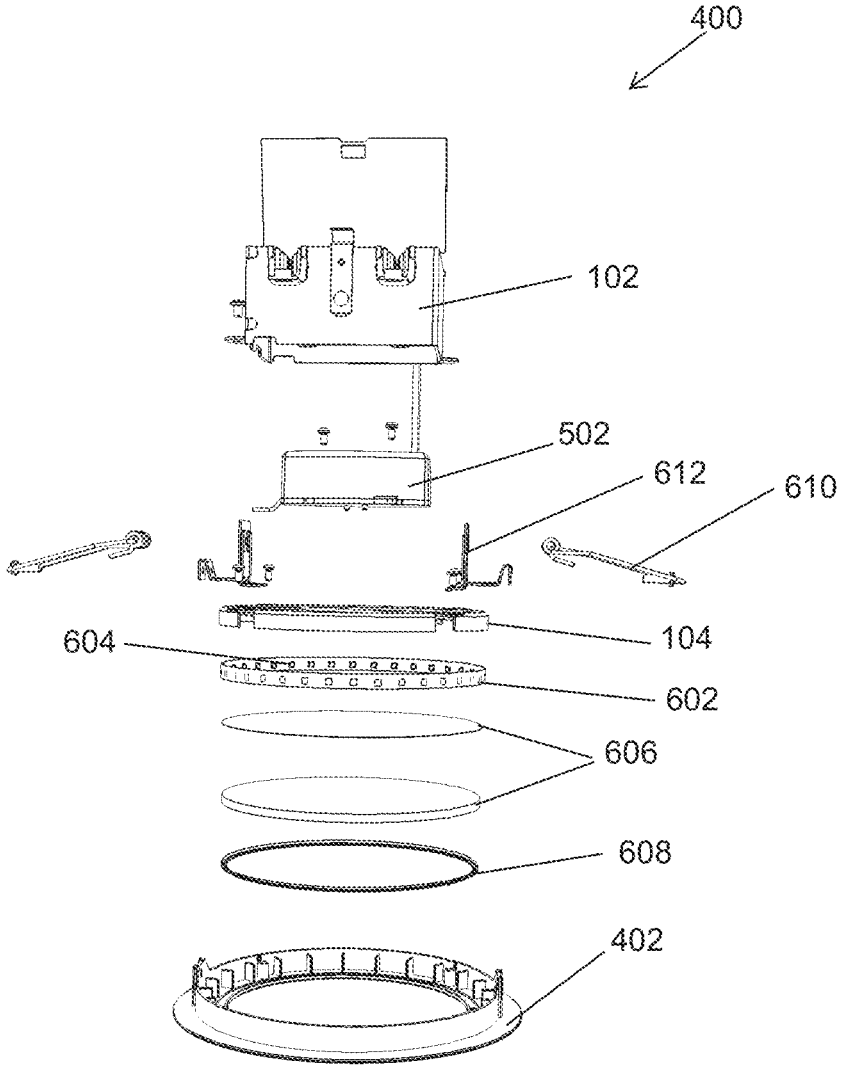
FIG. 6 illustrates an exploded view of the lighting fixture of FIG. 4 according to an example embodiment.

FIG. 6 illustrates an exploded view of the lighting fixture 400 of FIG. 4 according to an example embodiment. As illustrated in FIG. 6, the lighting fixture 400 includes the junction box 102, the mounting plate 104, the trim ring 402, and the driver 502. In some example embodiments, the lighting fixture 400 also includes a printed circuit board (PCB) 602 that includes LED light sources 604 attached thereon. For example, the PCB 602 may be attached to the skirt section 214 of the perimeter section 212 of the mounting plate 104 more clearly shown in FIG. 2. For example, the PCB 602 may be attached on the inside of the skirt section 214 below the ledge section 216 of the perimeter section 212. In some example embodiments, the LED light sources 604 may include one or more discrete light emitting diodes (LEDs), one or more organic LEDs (OLEDs), an LED chip on board that includes one or more discrete LEDs, and/or an array of discrete LEDs. In some alternative embodiments, the lighting fixture 400 may include another type of light source without departing from the scope of this disclosure. In some alternative embodiments, the PCB 602 may be replaced by another structure that includes the LED light sources 602 to be attached to the skirt section 214 of the perimeter section 212 of the mounting plate 104.

In some example embodiments, the lighting fixture 400 includes one or more optic structures 606 such as lenses. In some alternative embodiments, the optic structures 606 may include a single structure such as a lens without departing from the scope of this disclosure. In some example embodiments, the lighting fixture 400 may also include a gasket 608 that is positioned between the trim ring 402 and the optic structures 606.

As illustrated in FIG. 6, the lighting fixture 400 may also include mousetrap springs 610 and retention brackets 612 of retention structures 406, 408 shown in FIG. 4. In some alternative embodiments, different retention structures may be used to retain the lighting fixture 400 recessed in a ceiling without departing from the scope of this disclosure.

Figure 7:
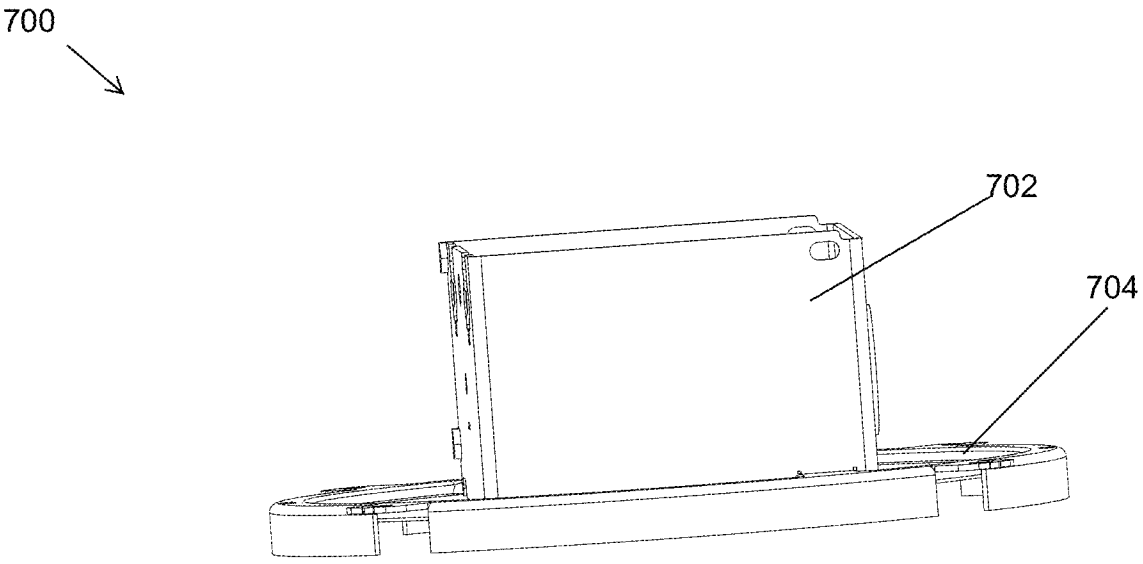
FIG. 7 illustrates a lighting structure including a junction box according to another example embodiment.

FIG. 7 illustrates a lighting structure 700 including a junction box 702 according to another example embodiment. In some example embodiments, the lighting structure 700 includes the junction box 702 and a mounting plate 704 that is integrally formed with the junction box 702. For example, the junction box 702 and the mounting plate 704 may be formed from a single sheet metal using means such as stamping. Alternatively, the junction box 702 and the mounting plate 704 may be formed as a single piece using methods such as die casting and or a combination of methods may be contemplated by those of ordinary skill in the art with the benefit of this disclosure.

In some example embodiments, the lighting structure 700 may be used in place of the lighting structure 100 in the lighting fixture 400 without departing from the scope of this disclosure.

Figure 8:
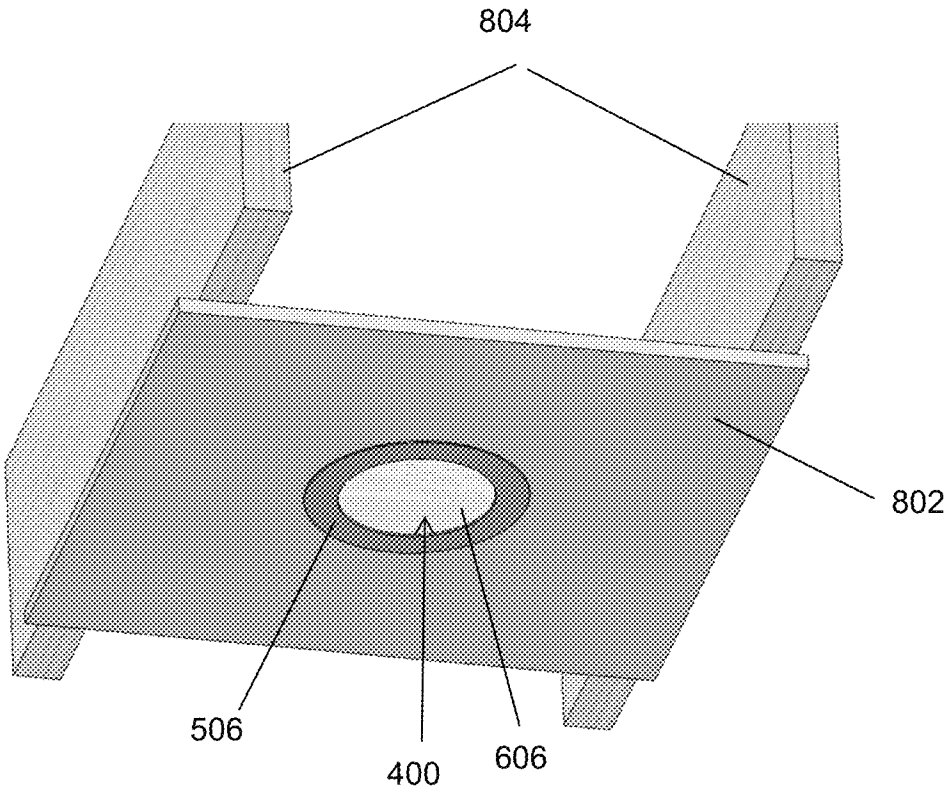
FIG. 8 illustrates a bottom perspective view of the lighting fixture of FIG. 4 recessed in a ceiling according to an example embodiment.
Figure 9:
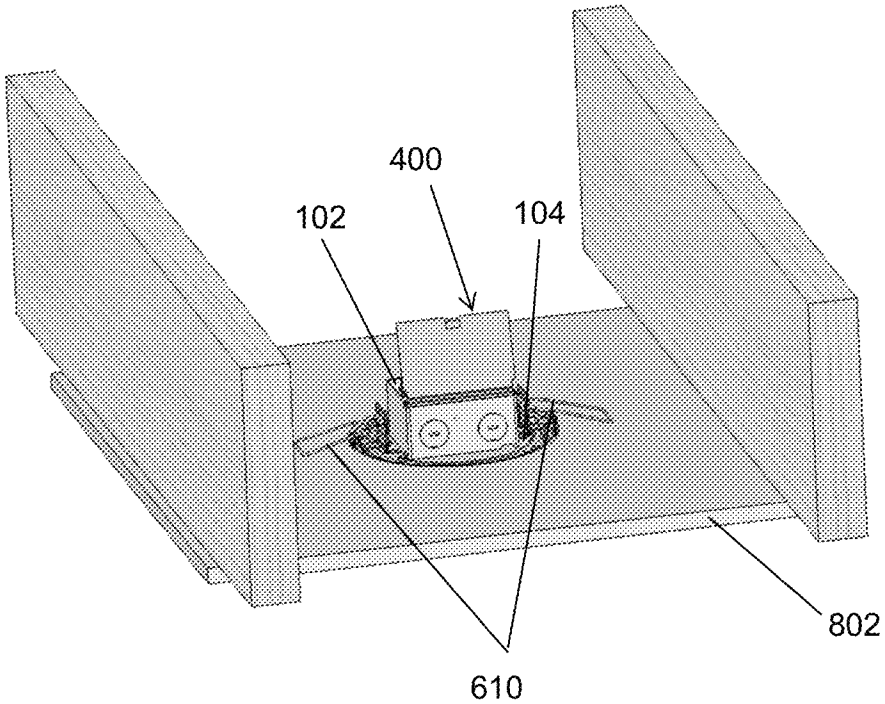
FIG. 9 illustrates a top perspective view of the lighting fixture of FIG. 4 recessed in a ceiling according to an example embodiment.
Figure 10:
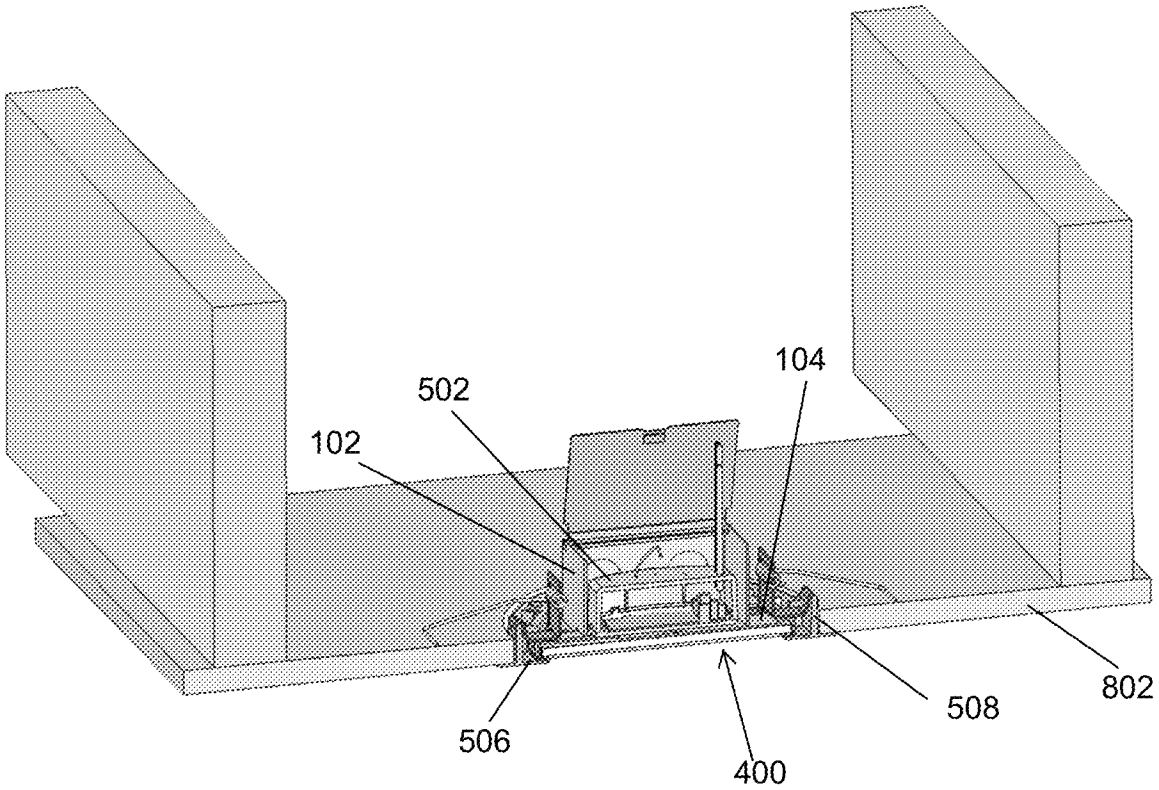
FIG. 10 illustrates a cross-sectional view of the lighting fixture of FIG. 4 recessed in a ceiling according to an example embodiment.

FIGS. 8-10 illustrate different views of the lighting fixture 400 of FIG. 4 recessed in a ceiling 802 according to an example embodiment. As more clearly illustrated in FIG. 8, a bottom perspective view of the lighting fixture, the trim piece 506 of the trim ring 402 of the lighting fixture 400 is flush with or below the ceiling 802 that may be attached to joists 804. The optic structures 606 of the lighting fixture 400 are visible from the bottom of the ceiling 802.

As more clearly shown in FIG. 9 that illustrates a top perspective view of the lighting fixture, the mousetrap springs 610 of the retention structures 406, 408 are clamped down on the ceiling 802 to retain the lighting fixture 400 recessed in the ceiling 802. The junction box 102 is generally positioned above the ceiling 802 over the mounting plate 104.

As more clearly shown in FIG. 10 that illustrates a cross-sectional view of the lighting fixture, in some example embodiments, the driver 502 is positioned inside the junction box 102. The trim piece 506 is positioned below the ceiling 802, and the insert piece 508 may be positioned in an opening of the ceiling 802.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A lighting structure, comprising:

a junction box having a cavity, wherein the junction box comprises a first tab and a second tab that extend outwardly from the junction box; and a mounting plate having an inner section, a perimeter section, and a wireway section extending between the inner section and the perimeter section, the wireway section having a wire opening therethrough and providing a wireway on an opposite side of the mounting plate from the junction box for routing an electrical wire from the cavity to the perimeter section, wherein the first tab is attached to the mounting plate by a fastener and wherein the second tab is inserted into a slot formed in the mounting plate.

2. The lighting structure of claim 1, wherein the mounting plate comprises tabs extending radially outwardly from the perimeter section of the mounting plate.

3. The lighting structure of claim 1, wherein the perimeter section of the mounting plate is outside the junction box.

4. The lighting structure of claim 1, wherein that first tab is on an opposite side of the junction box from the second tab.

5. The lighting structure of claim 4, wherein the slot is under an elevated section that is seamlessly formed in the mounting plate.

6. The lighting structure of claim 1, wherein the mounting plate includes a raised section that is seamlessly formed in the mounting plate, the raised section having an attachment hole for attaching a lighting driver to the mounting plate by a fastener.

7. The lighting structure of claim 6, wherein the junction box comprises a wire passageway in a wall of the junction box for extending one or more electrical wires into the cavity of the junction box.

8. The lighting structure of claim 1, wherein the junction box comprises a top cover that is moveable to provide access to the cavity of the junction box.

9. The lighting structure of claim 1, wherein the junction box comprises a knockout section in a wall of the junction box.

10. The lighting structure of claim 1, wherein the junction box and the mounting plate are integrally formed as a single structure.

11. A lighting fixture, comprising:

a light emitting diode (LED) light source;

a junction box having a cavity, wherein the junction box comprises a first tab and a second tab that extend outwardly from the junction box; and a mounting plate having an inner section, a perimeter section, and a wireway section extending between the inner section and the perimeter section, the wireway section having a wire opening therethrough and providing a wireway on an opposite side of the mounting plate from the junction box for routing an electrical wire from the cavity to the LED light source, wherein the LED light source is located at the perimeter section on the opposite side of the mounting plate from the junction box, wherein the first tab is attached to the mounting plate by a fastener, and wherein the second tab is inserted into a slot formed in the mounting plate.

12. The lighting fixture of claim 11, further comprising a lighting driver positioned in the cavity of the junction box.

13. The lighting fixture of claim 11, wherein the first tab is on an opposite side of the junction box from the second tab and wherein the slot is under an elevated section that is seamlessly formed in the mounting plate.

14. The lighting fixture of claim 11, further comprising a trim ring positioned around a circumference of the mounting plate, wherein the mounting plate comprises mounting tabs extending radially outwardly from the perimeter section, and wherein the mounting plate is attached to the trim ring using fasteners that extend through holes in the mounting tabs.

15. The lighting fixture of claim 11, further comprising a retention structure for retaining the lighting fixture recessed in a ceiling.

16. A lighting fixture, comprising:

a light emitting diode (LED) driver;

a junction box having a cavity, wherein the junction box comprises a first tab and a second tab that extend outwardly from the junction box and wherein the LED driver is positioned inside the cavity; and a mounting plate having an inner section, a perimeter section, and a wireway section extending between the inner section and the perimeter section, the wireway section having a wire opening therethrough and providing a wireway on an opposite side of the mounting plate from the junction box for routing an electrical wire between the LED driver in the cavity and the perimeter section, wherein the first tab is attached to the mounting plate by a fastener and wherein the second tab is inserted into a slot formed in the mounting plate.

17. The lighting fixture of claim 16, further comprising a light source attached to the perimeter section of the mounting plate on the opposite side of the mounting plate from the junction box.

18. The lighting fixture of claim 16, further comprising a trim ring positioned around the mounting plate, wherein the mounting plate is attached to the trim ring.

19. The lighting fixture of claim 16, wherein the mounting plate includes a raised section that is formed in the mounting plate, the raised section having an attachment hole for attaching the LED driver to the mounting plate.

20. The lighting fixture of claim 16, further comprising a retention structure for retaining the lighting fixture recessed in a ceiling.

* * * * *